US011292278B2

(12) United States Patent
Tabasso et al.

(10) Patent No.: US 11,292,278 B2
(45) Date of Patent: Apr. 5, 2022

(54) MACHINE FOR PRINTING IMAGES ON ARTICLES BY MEANS OF A THERMAL TRANSFER ROLLER

(71) Applicant: EIDOS S.r.l., Turin (IT)

(72) Inventors: Giovanni Tabasso, Turin (IT); Mauro Casetta, Cuneo (IT)

(73) Assignee: EIDOS S.R.L., Turin (IT)

( * ) Notice: Subject to any disclaimer, the term of this patent is extended or adjusted under 35 U.S.C. 154(b) by 334 days.

(21) Appl. No.: 16/322,906

(22) PCT Filed: Aug. 2, 2017

(86) PCT No.: PCT/IB2017/054720

§ 371 (c)(1),
(2) Date: Feb. 1, 2019

(87) PCT Pub. No.: WO2018/025196

PCT Pub. Date: Feb. 8, 2018

(65) Prior Publication Data

US 2019/0168526 A1 Jun. 6, 2019

(30) Foreign Application Priority Data

Aug. 2, 2016 (IT) ..... 102016000081050

(51) Int. Cl.
*B41J 31/12* (2006.01)
*B41J 2/33* (2006.01)
(Continued)

(52) U.S. Cl.
CPC ..... *B41J 31/12* (2013.01); *B41J 2/33* (2013.01); *B41J 35/04* (2013.01); *B41J 35/06* (2013.01); *G03G 15/14* (2013.01)

(58) Field of Classification Search
CPC ..... B41J 2/33; B41J 31/12; B41J 35/04; B41J 35/06; G03G 15/14
See application file for complete search history.

(56) References Cited

U.S. PATENT DOCUMENTS 4,172,418 A * 10/1979 Durand ..... B41F 16/00 101/194
5,135,319 A * 8/1992 Kobayashi ..... B41J 33/52 400/208
(Continued)

FOREIGN PATENT DOCUMENTS

EP 0856416 * 8/1998 ..... B41M 5/38
EP 1501683 A1 2/2005
(Continued)

*Primary Examiner* — Matthew G Marini
*Assistant Examiner* — Marissa Ferguson-Samreth
(74) *Attorney, Agent, or Firm* — Henry J. Cittone; Cittone Demers & Arneri LLP

(57) ABSTRACT

The printing machine (1) comprises: a supporting structure (11); a thermal transfer assembly (20) movable in a predetermined horizontal direction (21) and comprising a rotatable motorized transfer roller (30) and heating means (70, 71) associated to the transfer roller (30), wherein the transfer roller (30) and the associated heating means (70, 71) are movable vertically towards and away from a path of the articles (A) to be printed; and supply means (2; 12-16, 33-40) arranged to advance a printing ribbon (N) which on a side facing the articles (A) carries at predetermined intervals images formed of a thermally transferable ink. The thermal transfer assembly (20) further comprises first and second deviation rollers (35, 36) whose axes of rotation are horizontal and substantially parallel to one another and to the axis of rotation (x) of the transfer roller (30). The deviation rollers (35, 36) are arranged one upstream and the other downstream of the transfer roller (30) on the path of the printing ribbon (N) and are displaceable vertically towards and away from said path of the articles (A). The printing machine (1) further comprises first and second motor means (43, 44) associated each with a respective deviation roller (35, 36), said first and second motor means (43, 44) being controllable independently of one another,
(Continued)

whereby each of the deviation rollers (35, 36) is selectively displaceable vertically independently of the other one.

7 Claims, 8 Drawing Sheets

(51) Int. Cl.

| | |
|---|---|
| ***B41J 35/04*** | (2006.01) |
| ***B41J 35/06*** | (2006.01) |
| ***G03G 15/14*** | (2006.01) |

(56) References Cited

U.S. PATENT DOCUMENTS

| | | | | | |
|---|---|---|---|---|---|
| 5,908,251 | A * | 6/1999 | Buckby | ..... | B41J 17/12<br>400/231 |
| 7,153,048 | B2 * | 12/2006 | Tabasso | ..... | B41F 16/00<br>400/120.01 |
| 2016/0349675 | A1 * | 12/2016 | Yamamoto | ..... | G03G 15/2042 |

FOREIGN PATENT DOCUMENTS

| | | | | | |
|---|---|---|---|---|---|
| EP | 1974940 | * | 10/2008 | ..... | B41J 35/08 |
| EP | 2596945 | A1 | 5/2013 | | |
| EP | 2596954 | * | 5/2013 | ..... | B41J 2/0057 |
| GB | 2137561 | * | 10/1984 | ..... | B41F 13/18 |

* cited by examiner

MACHINE FOR PRINTING IMAGES ON ARTICLES BY MEANS OF A THERMAL TRANSFER ROLLER

CROSS-REFERENCE TO RELATED APPLICATIONS

This application is the U.S. National Stage of PCT International Patent Application No. PCT/IB2017/054720, filed Aug. 2, 2017, which claims priority to Italian Patent Application No. 102016000081050, filed Aug. 2, 2016 the disclosures of each of which are incorporated herein by reference in their entireties.

The present invention generally relates to machines for printing images on articles, such as cases or product packaging.

In the following description and claims, the term "image" is used to mean in a broad sense a text, a drawing, a logo, a code (such as a bar code or a two-dimensional code, for example a QR code or a Data Matrix code) or any other kind of two-dimensional graphic representation.

It is known to print codes and/or other types of images directly onto products already packaged, by means of the thermal transfer of ink from an inked ribbon.

In particular, the present invention relates to a printing machine for printing images on articles, comprising:

a supporting structure, stationary in operation, a thermal transfer assembly which is movable in a predetermined horizontal direction and comprises a motorized rotating transfer roller and heating means associated with the transfer roller, wherein the transfer roller has at least one outer layer of a synthetic material, with a peripheral surface facing the path of the articles, and wherein the transfer roller and the associated heating means are movable vertically in said thermal transfer assembly towards and away from said path of the articles, and supply means arranged to advance, along a predetermined path which extends partially between the active surface of the transfer roller and the path of the articles, a flexible printing ribbon which on a side facing the articles carries at predetermined intervals images formed of a thermally transferable ink, wherein the thermal transfer assembly further comprises first and second deviation rollers, whose axes of rotation are substantially horizontal and parallel with one another and with the axis of rotation of the transfer roller, as well as substantially orthogonal to said predetermined horizontal direction, said deviation rollers being placed one upstream and the other one downstream of the transfer roller along the path of said printing ribbon and being vertically movable in the thermal transfer assembly towards and away from said path of the articles.

A printing machine the type specified above is disclosed in EP 1 501 683 B1 in the Applicant's name.

In such a known machine the vertical position of each of said deviation rollers is adjustable independently of that of the other one. However, once the vertical positions of these rollers have been adjusted, the rollers can be moved vertically only jointly.

It is an object of the present invention to provide a printing machine of the type specified above, which has a greater flexibility of operation.

This and other objects are achieved according to the present invention by virtue of a printing machine of the type defined above, wherein first and second motor means controllable independently of one another are associated to said first and second deviation rollers, respectively, whereby each of said first and second deviation rollers is selectively movable vertically independently of the other one.

Preferably, the printing machine further comprises control means arranged to cause in operation a joint vertical downward displacement of the transfer roller and said first and second deviation rollers, so that the portion of the printing ribbon extending between said deviation rollers is kept at a distance from the transfer roller, a vertical downward displacement of the transfer roller relative to said deviation rollers towards said portion of the printing ribbon until said transfer roller contacts said portion of the printing ribbon, resting on the surface of the article intended to be printed, and a subsequent vertical upward displacement, selectively simultaneous or sequential, of said deviation rollers while the transfer roller is still in contact with said portion of the printing ribbon, and then a lifting of the transfer roller from said portion of the printing ribbon, once the printing process has been completed.

According to an embodiment of the present invention, the transfer roller has a shaft which is associated with an electric driving motor arranged to cause rotation of said shaft in a predetermined direction, the shaft of the transfer roller being in particular coupled to said motor via a unidirectional joint (for example an overrunning clutch) and a universal joint.

Conveniently, the heating means associated with the transfer roller may comprise a body of thermally refractory material extending around and at a predetermined distance from the transfer roller, wherein a plurality of infrared radiation emitting elements of a resistive type with low thermal inertia are mounted on the surface of said roller facing the transfer roller, contactless temperature sensor means associated with the transfer roller for providing electric signals indicative of the temperature of the peripheral surface of the transfer roller, and control means arranged to modify a supply voltage supplied to said infrared radiation emitting elements, as a function of the signals provided by said sensor means.

Further characteristics and advantages of the invention will become apparent from the following detailed description, given purely by way of non-limiting example with reference to the accompanying drawings, wherein.

Figure 1:
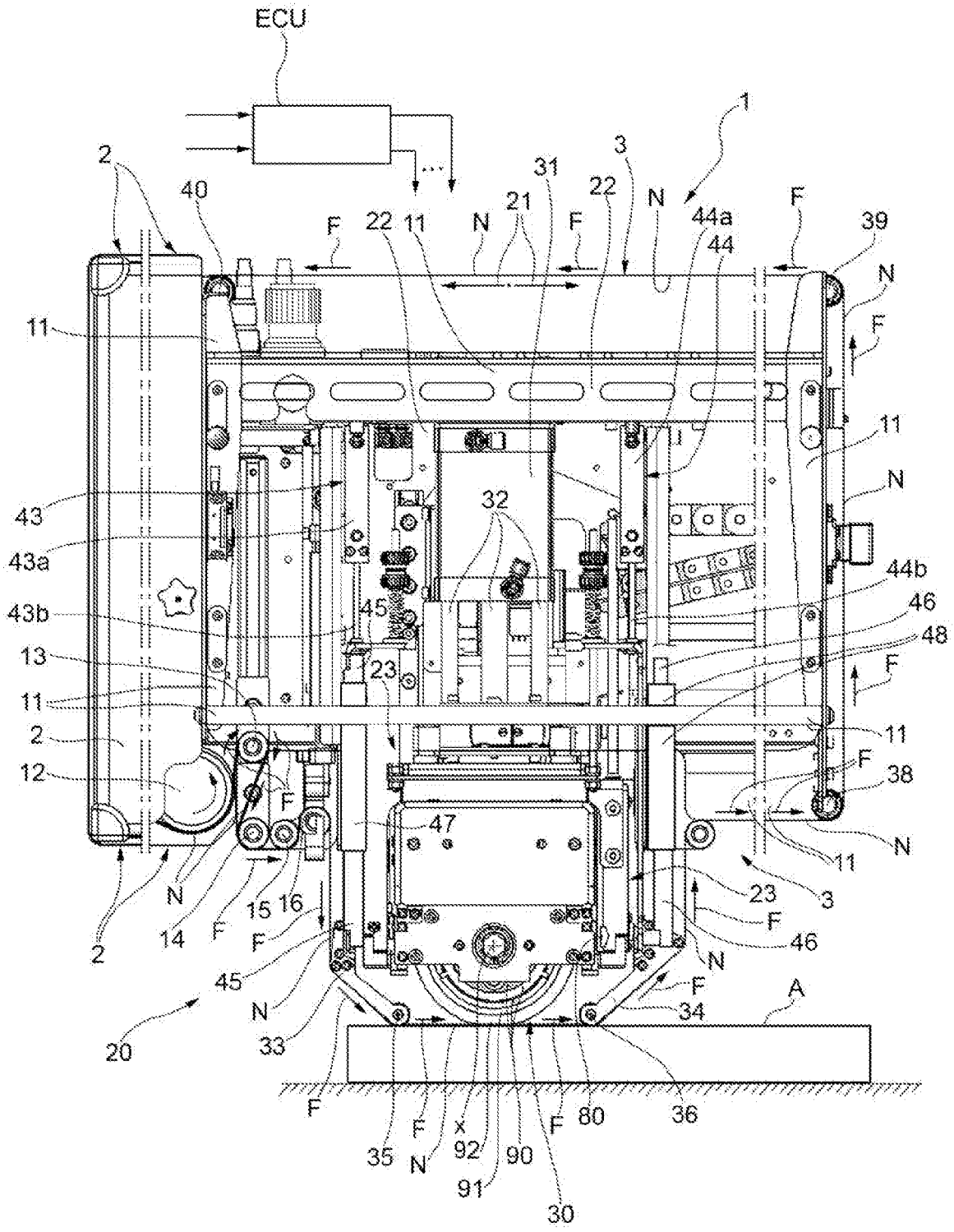
FIG. 1 is a partial front view of a printing machine for printing images on articles according to an embodiment of the present invention.
Figure 2:
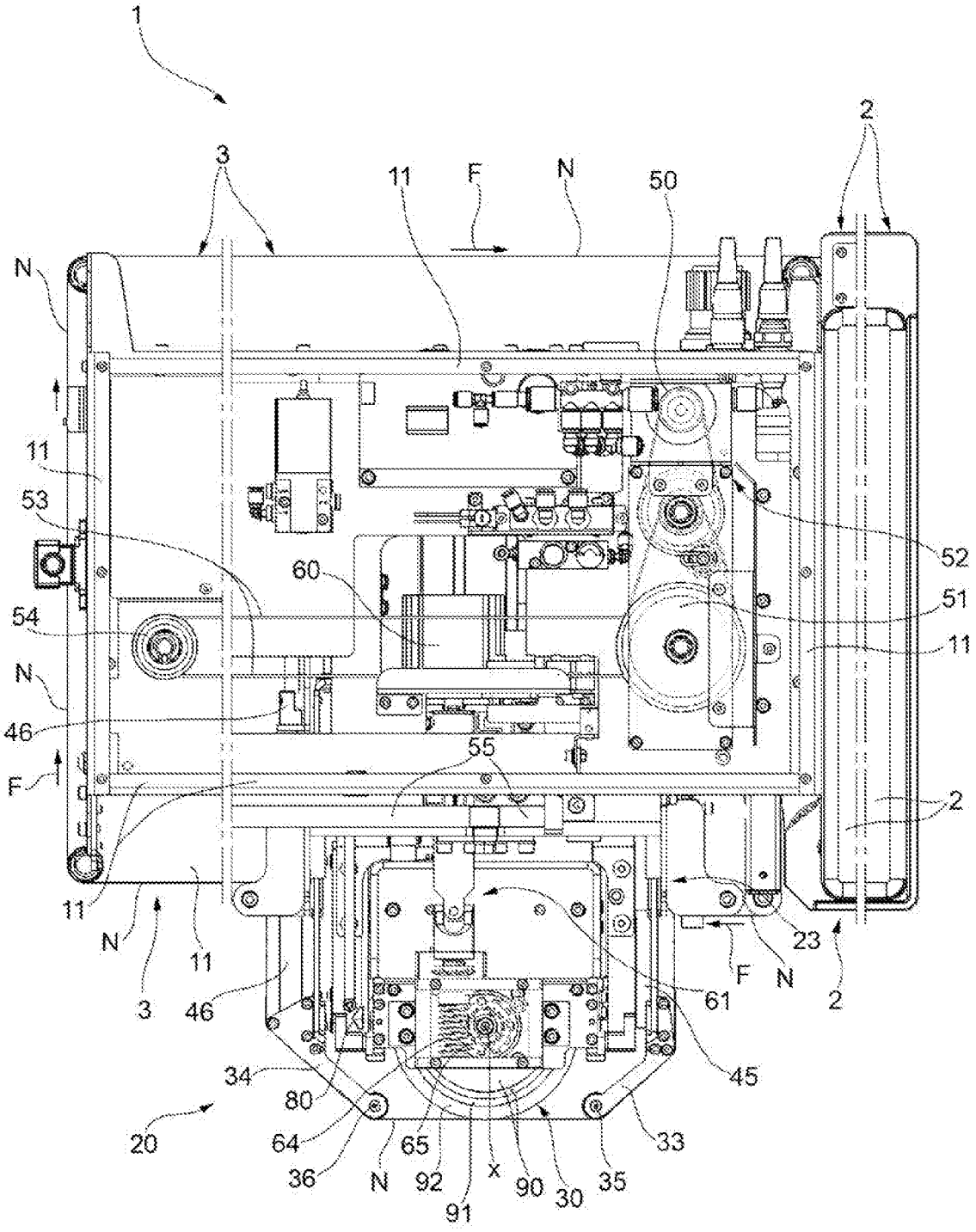
FIG. 2 is a partial rear view of the machine of FIG. 1.

With reference first to FIGS. 1 and 2, a printing machine for printing images on articles according to the present invention (hereinafter simply referred to as "machine") is generally indicated 1.

The machine 1 comprises a preparation and feeding section 2 for preparing and feeding a printing ribbon N, and an adjacent image transfer section 3 for transferring images on articles A fed to the machine 1 along a substantially horizontal path.

The preparation and feeding section 2 is for example of the type described and illustrated in detail in the European patent cited above, and will therefore not be further described herein.

The image transfer section 3 comprises first of all a supporting structure 11, firmly connected to the section 2.

In the machine 1 the printing ribbon N, which on its side intended to be facing the articles A carries at predetermined intervals images formed of a heat-transferable ink, follows an operating path defined by a plurality of deviation rollers, some of which are motorized. With reference to FIG. 1, this operating path is indicated by a plurality of arrows F.

At the output from the section 2 of the machine 1, the printing ribbon N passes from a deviation roller 12 of this section to a deviation roller 13 of the adjacent section 3, then under two deviation rollers 14 and 15, and subsequently above a deviation roller 16 (FIG. 1).

The section 3 includes a thermal transfer assembly, generally indicated 20, which is movable along a predetermined horizontal direction indicated by double arrow 21 in FIG. 1.

The thermal transfer assembly 20 comprises a vertically fixed part 22 (hereinafter simply referred to as "fixed part") and a vertically movable part 23 (hereinafter simply referred to as "movable part"), which is vertically translatable with respect to the fixed part 22.

The movable part 23 carries a motorized transfer roller 30 which is rotatable about a substantially horizontal axis, indicated x in FIG. 1, above a length of the path of the printing ribbon N.

The horizontal axis X is substantially orthogonal to the horizontal direction 21 of translation of the thermal transfer assembly 20 with respect to the supporting structure 11.

In the illustrated embodiment, the thermal transfer assembly 20 comprises a fluidic cylinder 31, preferably a dual-effect fluidic cylinder, attached to the fixed part 22 of this assembly. The fluidic cylinder 31 has a plurality of stems 32 connected to the movable part 23 of the thermal transfer assembly 20 carrying the transfer roller 30.

Figure 4:
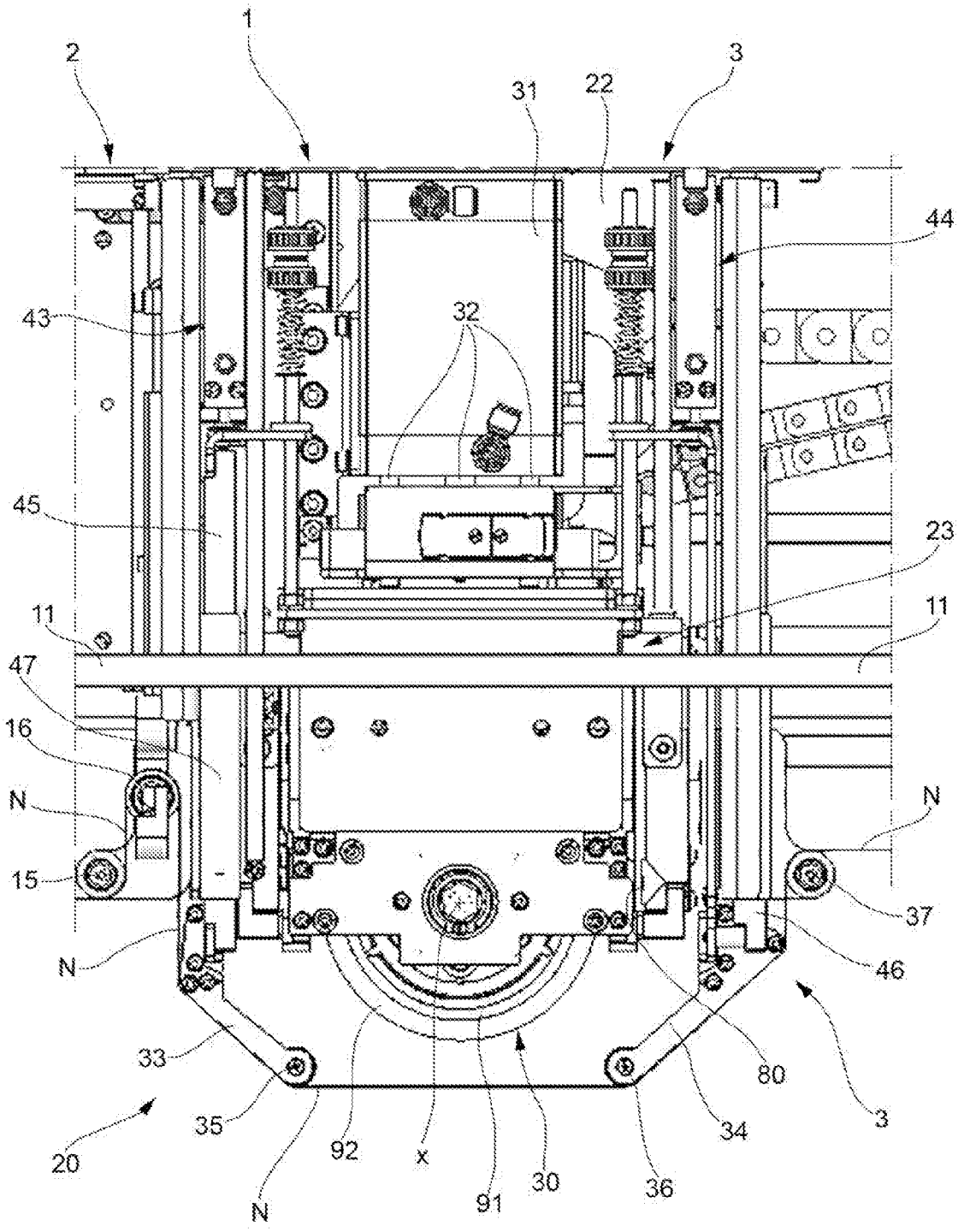
FIGS. 4 to 7 are partial front views of the machine of FIGS. 1 and 2, shown in four different operating conditions.

By means of the fluidic cylinder 31, the movable part 23 of the thermal transfer assembly 20 can be moved vertically between a raised disengagement position, shown in FIG. 4, and a lowered engagement position, shown in FIG. 1, in which the transfer roller 30 engages in contact with a portion of the printing ribbon N on an underlying article A for transferring an image from this portion of the printing ribbon to the article.

Downstream of the deviation roller 16, the printing ribbon N extends and slides along a first arm 33, at the lower end of which there is mounted a deviation roller 35, whose axis of rotation is parallel to the horizontal axis x. The deviation roller 35 is located upstream of the transfer roller 30, in the path of the printing ribbon N.

Downstream of the transfer roller 30, the printing ribbon N reaches a deviation roller 36 mounted at the lower end of a second arm 34. Downstream of the deviation roller 36, the printing ribbon N follows the profile of the lower part of the second arm 34, and then extends upwards towards a deviation roller 37, over which the printing ribbon N continues horizontally up to a deviation roller 38.

Downstream of the deviation roller 38, the printing ribbon N extends vertically upwards, up to a deviation roller 39 at which the printing ribbon N is deviated horizontally towards a deviation roller 40 and of the section 2 of the machine 1. Inside the section 2 the printing ribbon N reaches a motorized rewind reel, in a manner known per se and not illustrated.

The arms 33 and 34 are mounted in the thermal transfer assembly 20 so as to be vertically movable with respect to the fixed part 22 of this assembly, but are drivingly connected for translation with this assembly along the above-mentioned predetermined horizontal direction.

In order for the arms 33 and 34 to move vertically in the thermal transfer assembly 20 there are provided two fluidic cylinders 43 and 44, comprising respective bodies 43*a* and 44*a* connected to the fixed part 22 of the assembly 20, and respective rods 43*b* and 44*b* connected to the arms 33 and 34 through respective vertical bars 45 and 46. The vertical bars 45 and 46 are vertically slidable in respective vertical guides 47 and 48, which are vertically fixed (see in particular FIG. 1).

The deviation rollers 35 and 36 carried by the arms 33 and 34 have the respective axes of rotation substantially parallel to one another and parallel to the axis of rotation x of the transfer roller 30. Moreover, the axes of rotation of the deviation rollers 35 and 36 are orthogonal to the direction of translation (indicated by double arrow 21) of the thermal transfer assembly 20 with respect to the supporting structure 11 of the machine 1.

The deviation rollers 35 and 36 are arranged one upstream and the other downstream of the transfer roller 30, near the path of the printing ribbon N, and are vertically displaceable in the thermal transfer assembly 20, towards and away from the path of the articles A, by means of the fluidic cylinders 43 and 44.

The fluidic cylinders 43 and 44 may be double-acting or single-acting cylinders and are configured to cause lowering of the arms 33 and 34 and of the associated deviation rollers 35 and 36 and their return back to the retracted position. In case of single-acting fluidic cylinders, their return back to the retracted position is obtained by means of springs (not shown) provided inside or outside these cylinders.

The machine 1 further comprises a control unit ECU, for example housed in a separate support casing, to control the operation of the machine.

Since separate driving devices (fluidic cylinders 43 and 44), operable independently of one another, are associated with the arms 33 and 34, the arms 43 and 44 and the associated deviation rollers 35 and 36 are selectively vertically displaceable, independently of one another.

With reference to FIG. 2, in the stationary part of the machine 1 there is provided an electric motor 50 for driving the horizontal movement of the thermal transfer assembly 20. The electric motor 50 is arranged for example with the axis of rotation of its motor shaft oriented horizontally.

The electric motor 50 is coupled to a first pulley 51 via an intermediate transmission, generally indicated 52. A belt 53 extends between the first pulley 51 and a second pulley 54 and is connected to the thermal transfer assembly 20, in such a way that actuation of the electric motor 50 causes a translation of the thermal transfer assembly 20 along a horizontal guide indicated 55 in FIG. 2.

Figure 3:
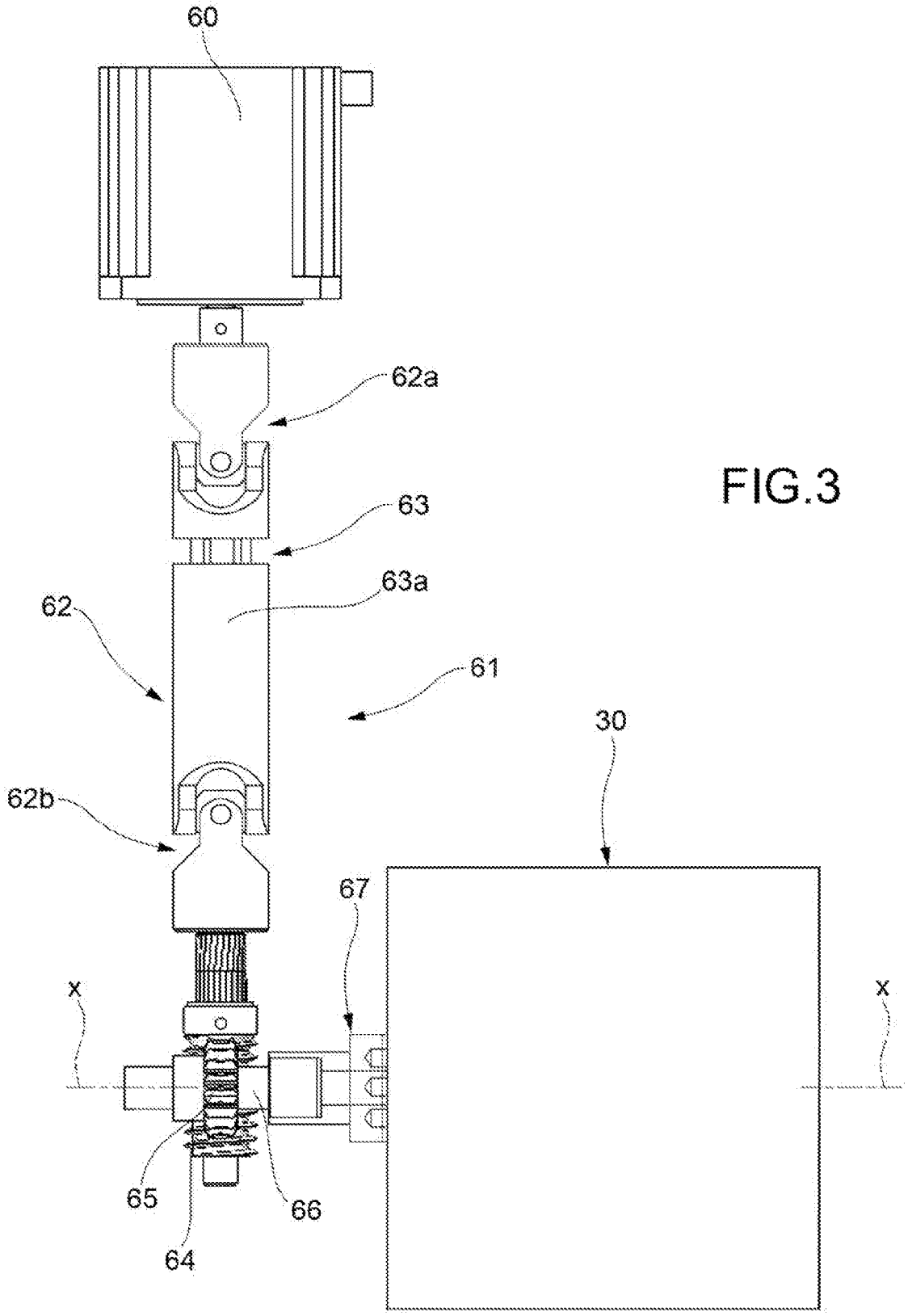
FIG. 3 is a thermal transfer roller and an associated rotation driving device included in the machine of FIGS. 1 and 2.

With reference to FIGS. 2 and 3, an electric motor 60 is associated to the transfer roller 30 for driving rotation of that roller. The electric motor 60 is fixed in the thermal transfer assembly 20. The motor shaft of the electric motor 60 extends vertically and is coupled to the (substantially) horizontal shaft of the transfer roller 30 via a transmission, generally indicated 61 (see in particular FIG. 3). In the illustrated embodiment, the transmission 61 comprises a universal joint 62, including two half-joints 62*a* and 62*b*, that is, an upper half-joint and a lower half-joint, respectively, coupled to each other via a sliding joint 63 comprising a sleeve 63*a* slidably coupled to a grooved member 63*b*.

The upper half-joint 62*a* is coupled to the motor shaft of the electric motor 60, while the lower half-joint 62*b* is coupled to a worm screw 64, which meshes with a sprocket 65 having a (substantially) horizontal axis and carried by a shaft 66 (see FIG. 3). The shaft 66 is coupled to the shaft of the transfer roller 30, preferably via a unidirectional joint 67 (for example an overrunning clutch). The unidirectional joint 67 allows rotation of the transfer roller 30 in one direction only and, as better described hereinafter, performs the important function of preventing, during printing, a sliding of the transfer roller 30 on the length of the printing ribbon N between the deviation rollers 35 and 36.

The transmission 61 is such that in operation the axis of the transfer roller 30 can tilt with respect to the horizontal plane, in order to better mate with the surface of an article A on which an image has to be transferred.

Figure 8:
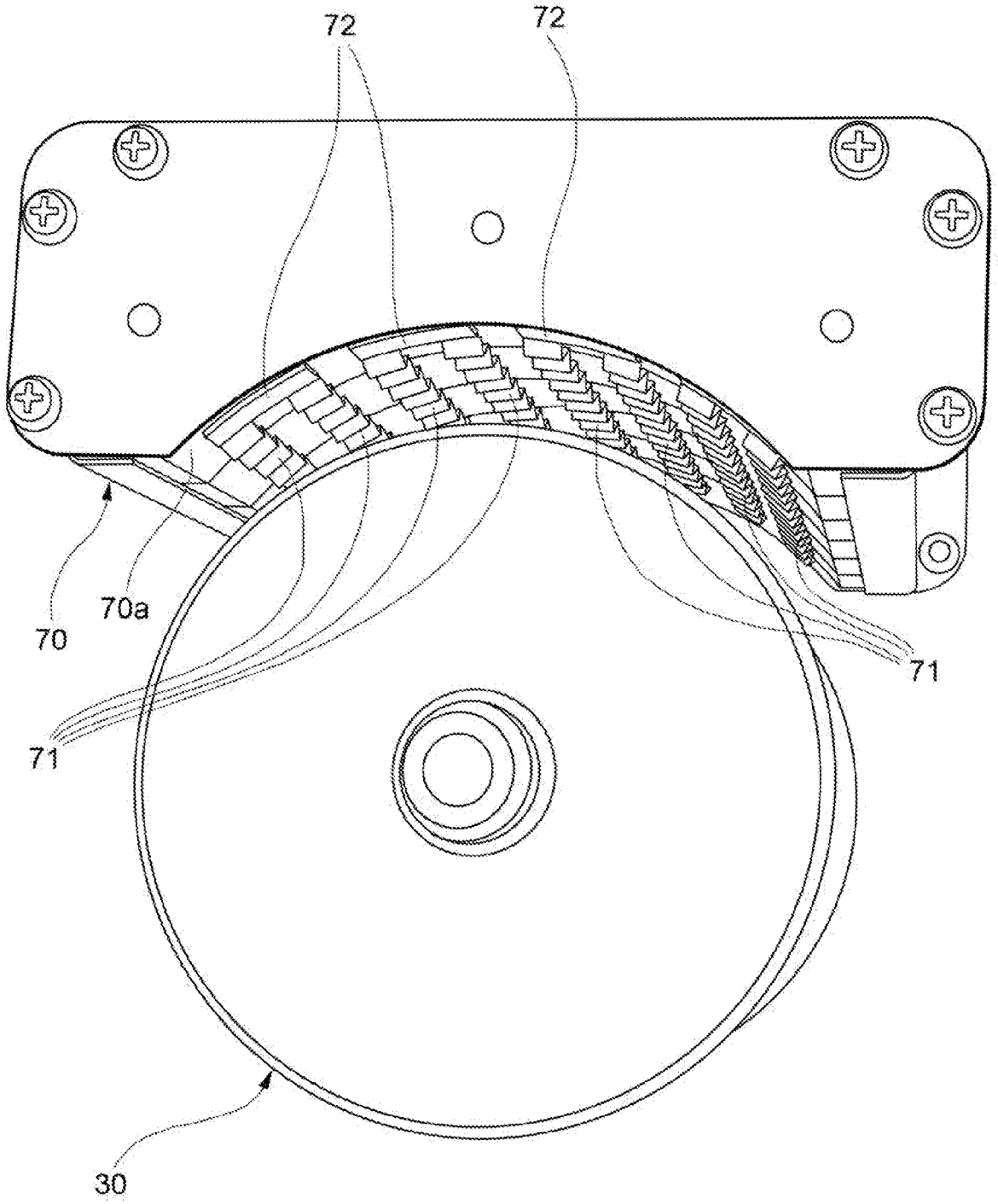
FIG. 8 is a partial perspective view showing the thermal transfer roller and an associated heating device included in the machine of FIGS. 1 and 2.

In the movable part 23 of the thermal transfer assembly 20 a heating device is associated with the transfer roller 30 and, as shown in FIG. 8, comprises a body 70 which is made of thermally refractory material and extends around, and at a predetermined distance from, the upper part of the transfer roller 30. The body 70 has in particular an arched surface 70*a*, substantially shaped as a cylindrical surface portion coaxial with the transfer roller 30, on which a plurality of infrared radiation emitting elements 71 of the resistive type, with low thermal inertia, are mounted. These radiation emitting elements 71 are for example shaped as strips of resistive material, for example tungsten-based, folded like an accordion, and interconnected in series with each other at their ends by means of metal plates 72.

A supply voltage, for example a voltage of between 48 and 230 V in alternating current, is applied in operation to the series formed by the radiation emitting elements 71. The current correspondingly flowing in the radiation emitting elements 71 causes the very rapid heating of the latter up to an operating temperature which depends on the value of the voltage applied. The voltage applied may be varied in a manner known per se, for example by means of a phase angle control circuit.

The radiation emitting elements 71 heat up, by means of infrared radiation, the upper portion of the peripheral surface of the transfer roller 30, to allow then the thermal transfer of the images from the printing ribbon N on an underlying article A.

In view of the printing of an image, the transfer roller 30 is set in rotation, in such a way that its peripheral surface is heated by the infrared radiation emitted by the radiation emitting elements 71.

Once the printing process has been carried out, the rotation of the roller 30 is stopped and the supply of voltage to the radiation emitting elements 71 is interrupted.

Due to the low thermal inertia of the radiation emitting elements 71, the generation of heat towards the transfer roller 30 ceases almost instantaneously as soon as the voltage supply to the radiation emitting elements 71 is interrupted. The risk that the transfer roller 30, no longer driven into rotation, may be damaged by an excessive heat applied to its upper portion is thus prevented.

Conveniently, in order to allow a precise control of the peripheral temperature of the transfer roller 30, a temperature sensor 80 (see, for example, FIG. 1) of the contactless type is associated with this roller and is arranged to provide electrical signals indicative of the temperature of the peripheral surface of this roller. A control circuit arranged to modify the voltage supplied to the radiation emitting elements 71 depending on the detected temperature is conveniently associated with the temperature sensor 80.

With reference for example to FIG. 1, preferably the transfer roller 30 has a core 90 of cylindrical shape, made for example of aluminum, on which a layer 91 of soft elastic synthetic material, such as a heat-insulating silicone rubber having a hardness of about 40 degrees Shore is applied. An outer layer 92 of relatively more rigid synthetic material, such as a layer of silicone rubber charged with thermally conductive particles, having a hardness for example between about 70 and about 80 degrees Shore, is arranged around the layer 91. The relatively softer layer 91 reduces the hardness of the outer layer 92, and also acts as a thermal barrier to the core 90 of the transfer roller 30.

By virtue of the structure of the transfer roller 30 described above, the heat radiated in operation by the radiation emitting elements 71 is essentially confined on the outermost layer 92 of this roller.

The printing machine 1 described above substantially operates in the following manner.

When the machine 1 is at rest, it has the configuration shown for example in FIG. 4: the transfer roller 30 is in the raised position, and so are the arms 33 and 34 carrying the deviation rollers 35 and 36. In this condition, the length of the printing ribbon N between the deviation rollers 35 and 36 is spaced from the peripheral surface of the transfer roller 30.

In view of the printing of an image on an article A, the control unit ECU of the machine 1 determines the positioning, between the deviation rollers 35 and 36, of a length of the printing ribbon N carrying the image formed of thermal-transferable ink, intended to be printed on the article. The transfer roller 30 is set in rotation by the electric motor 60 and the associated infrared radiation emitting elements 71 are activated.

The control unit ECU then causes the joint descent of the transfer roller 30 and of the arms 33 and 34, by activation of the fluidic cylinders 31, 43 and 44.

During this joint descent, the transfer roller 30, still spaced from the printing ribbon N, is kept in rotation by the electric motor 60, and its peripheral surface is kept heated by the radiation emitting elements 71.

The arms 33 and 34 then bring the length of the printing ribbon N between the deviation rollers 35 and 36 in contact with the upper surface of the article A.

The rotation of the transfer roller 30 is then stopped and the transfer roller thus comes in contact with the upper side of the length of the printing ribbon N which is already in contact with the article A. The rotation of the transfer roller 30 is subsequently resumed and, through the simultaneous activation of the electric motors 50 and 60, the control unit ECU determines the rolling movement of the transfer roller 30 on the length of the printing ribbon N that is in contact with the upper surface of the article A.

As a result of this rolling movement, the transfer roller 30, which is kept pressed against the printing ribbon N and the article A, progressively causes the ink image to be transferred from the printing ribbon N to the surface of the article A.

In this phase, the unidirectional joint 67 allows the rotation of the transfer roller 30 at the highest speed among that imparted to this roller by the associated electric motor 60 and that imparted to the roller due to the displacement of the thermal transfer assembly 20 caused by the electric motor 50.

The sliding of the transfer roller 30 on the printing ribbon N and the resulting printing defects are thus avoided.

Once the printing process has been completed, the control unit ECU causes the raising of the printing roller 30 and of the arms 33 and 34 to cause the detachment of the printing ribbon N from the article A.

Figure 5:
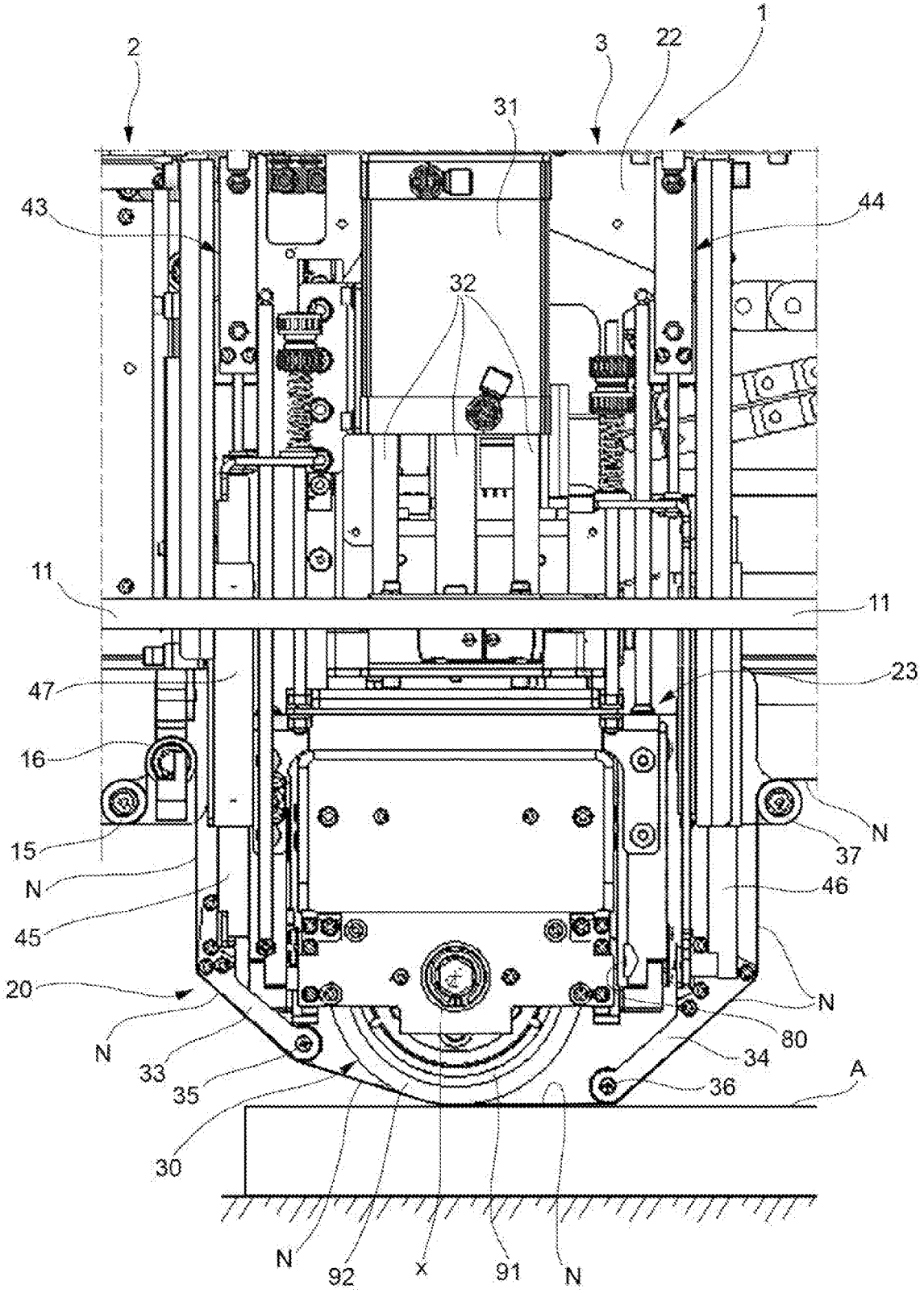
Figure 6:
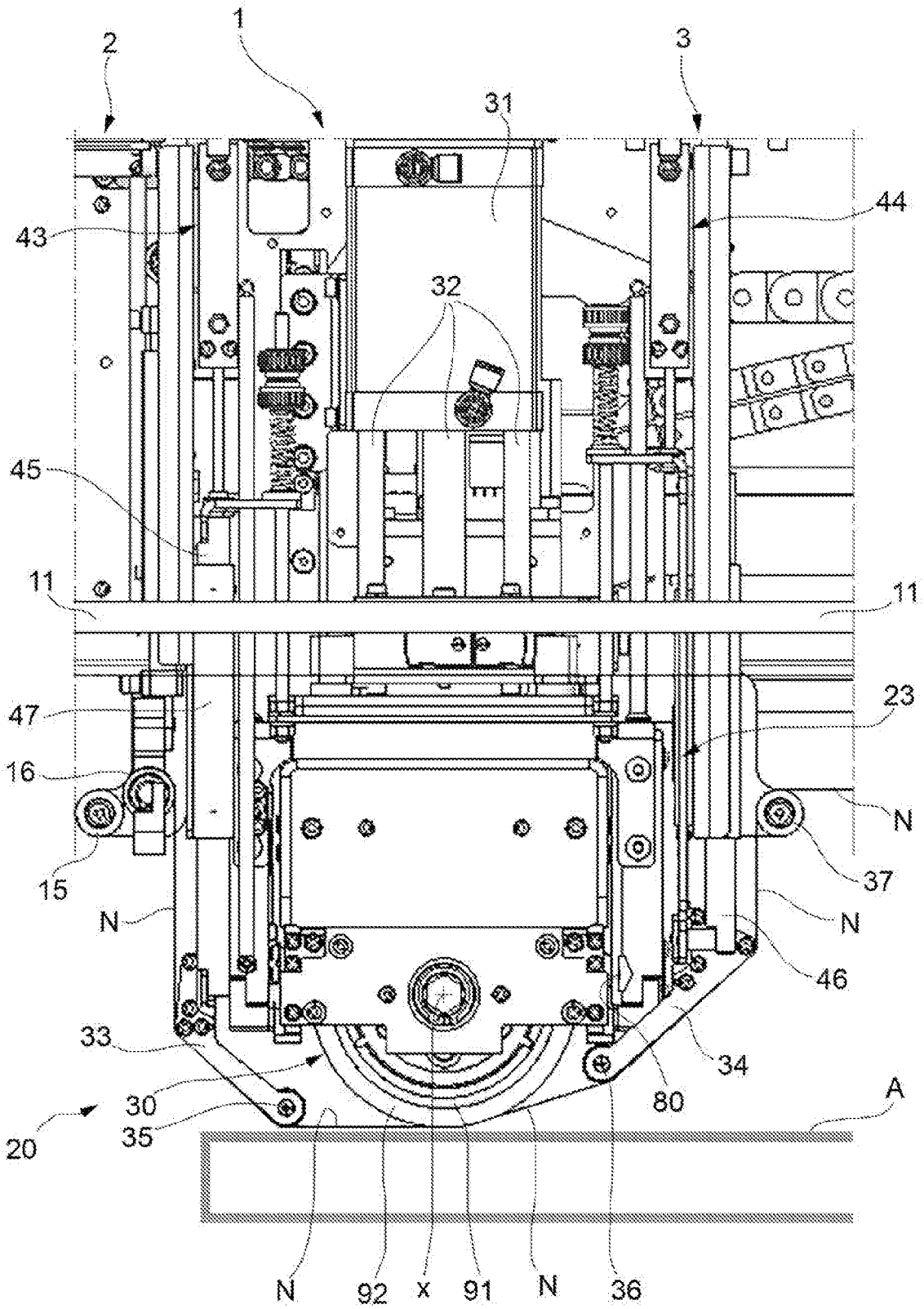

Depending on the characteristics of the printing ribbon and/or the ink used and/or the article on which the printing is made, it may be convenient to make the detachment of the printing ribbon N from the surface of the article A occur first at the deviation roller 35 located upstream of the transfer roller 30 (FIG. 5), or first at the deviation roller 36 located downstream of the transfer roller 30 (FIG. 6). The control unit ECU of the machine 1 may be conveniently set in a corresponding manner and carry out the most convenient detachment method by suitably controlling the fluidic cylinders 43 and 44.

Figure 7:
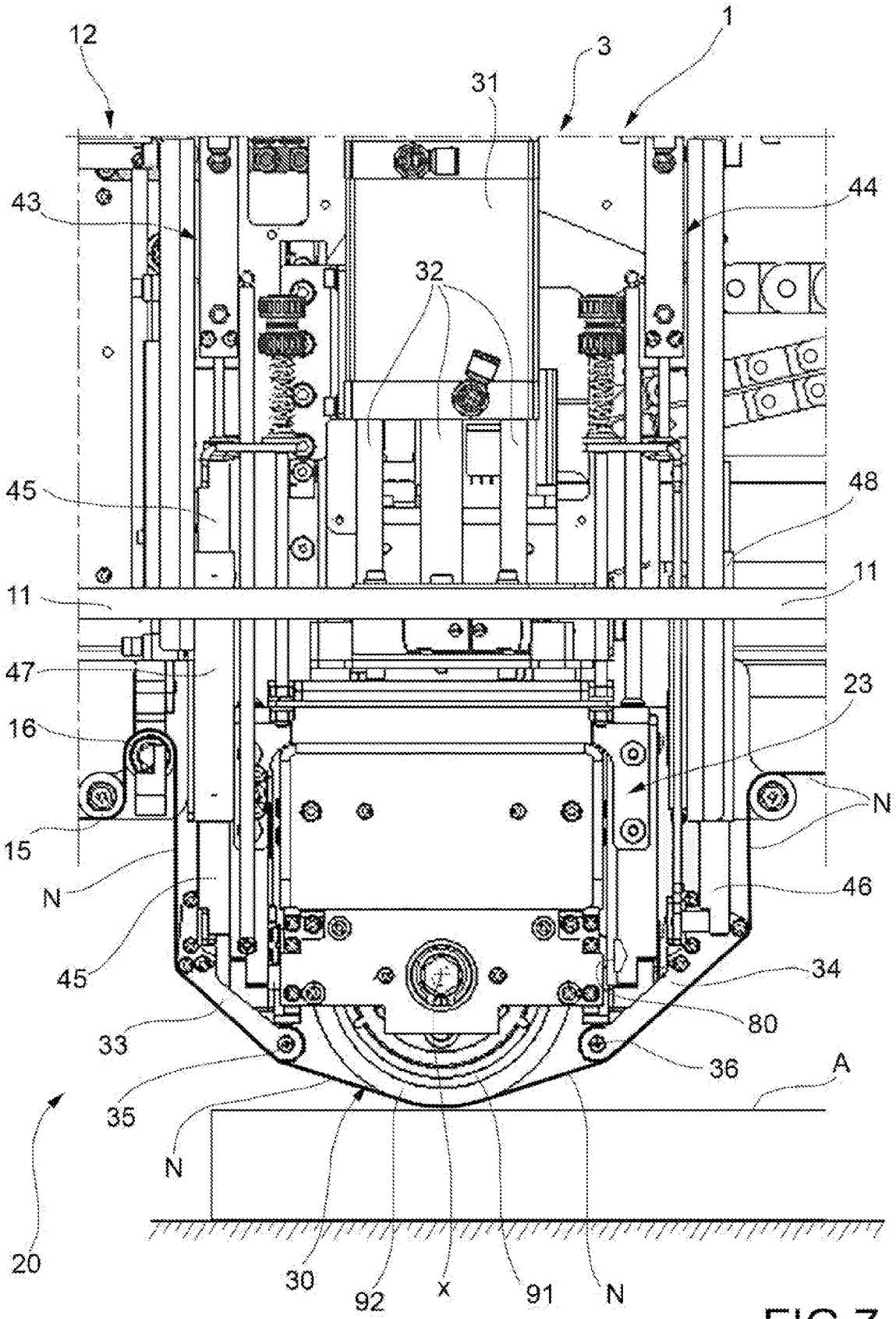

In certain conditions it may be convenient to carry out the detachment of the printing ribbon N simultaneously at both deviation rollers 35 and 36, and in this case the control unit ECU may be arranged to control the fluidic cylinders 43 and 44 in such a way as to simultaneous lift the arms 33 and 34, as shown in FIG. 7.

The control unit ECU then causes the transfer roller 30 to shift to the raised rest condition of FIG. 4 and the thermal transfer assembly 20 to return back to the initial position.

The machine according to the present invention has a very flexible operation, in particular with regard the control of the application and detachment of the printing ribbon from the articles. In addition, heating of the transfer roller can be carried out very quickly, without initial waiting times, and also deactivated with no risks of damaging this roller. Finally, also the movement of the transfer roller is managed in an improved manner with respect to the prior art.

Naturally, the principle of the invention remaining unchanged, the embodiments and manufacturing details may widely vary compared to those described and illustrated purely by way of a non-limiting example, without thereby departing from the scope of the invention as defined in the accompanying claims.

The invention claimed is:

1. A printing machine—for printing images on articles, comprising:

a supporting structure, stationary in operation, a thermal transfer assembly movable in a predetermined horizontal direction and comprising a rotatable motorized transfer roller and heating means associated to the rotatable motorized transfer roller wherein rotatable motorized transfer roller has at least one outer layer of synthetic material with a peripheral surface facing a path of the articles and wherein rotatable motorized transfer roller and the associated heating means are movable vertically in said thermal transfer assembly towards and away from said path of the articles, and supply means arranged to advance, along a predetermined path extending in part between the active surface of rotatable motorized transfer roller and the path of the articles, a flexible printing ribbon which on a side facing the articles carries at predetermined intervals images formed of a thermally transferable ink, wherein the thermal transfer assembly further comprises first and second deviation rollers, whose axes of rotation are horizontal and substantially parallel with one another and with a axis of rotation (x) of rotatable motorized transfer roller and are also orthogonal to said redetermined horizontal direction, said first and second deviation rollers being placed one upstream and the other one downstream of rotatable motorized transfer roller on the path of said printing ribbon and being vertically movable in the thermal transfer assembly towards and away from said path of the articles, characterized in that said printing machine further comprises first and second motor means associated with said first and second deviation rollers, respectively, said first and second motor means being controllable independently of one another such that each of said first and second deviation rollers is selectively movable vertically independently of the other one, and wherein said heating means comprise a body of thermally refractory material, which extends around, and at a predetermined distance from, a portion of the rotatable motorized transfer roller, on a surface of the body facing the rotatable motorized transfer roller there being mounted a plurality of infrared radiation emitting elements of resistive type, contactless temperature sensor means associated with the rotatable motorized transfer roller and arranged to provide electric signals indicative of a temperature of a peripheral surface thereof, and control means arranged to modify a supply voltage supplied to said plurality infrared radiation emitting elements as a function of the signals provided by said sensor means.

2. The printing machine according to claim 1, further comprising control means (ECU) arranged to cause in operation a joint vertical downward displacement of rotatable motorized transfer roller and said first and second deviation rollers, such that the length of the printing ribbon extending between said first and second deviation rollers is kept at a distance from rotatable motorized transfer roller, a vertical downward displacement of rotatable motorized transfer roller relative to said first and second deviation rollers towards said length of the printing ribbon until rotatable motorized transfer roller contacts said length of the printing ribbon, a subsequent vertical upward displacement, selectively simultaneous or sequential, of said first and second deviation rollers while rotatable motorized transfer roller is still in contact with said length of the printing ribbon, and then a lifting of rotatable motorized transfer roller from said length of the printing ribbon once a printing process has been completed.

3. The printing machine according to claim 1, further comprising an electric motor coupled with rotatable motorized transfer roller via a unidirectional joint to cause the rotation of rotatable motorized transfer roller in a predetermined direction, whereby while the thermal transfer assembly is moved relative to the supporting structure along said predetermined horizontal direction corresponding to a direction of rotation of rotatable motorized transfer roller, the unidirectional joint allows rotatable motorized transfer roller to rotate to a highest speed among a speed imparted to rotatable motorized transfer roller by the electric motor and a speed imparted to rotatable motorized transfer roller as result of the translational movement of the thermal transfer assembly.

4. The printing machine according to claim 3, further comprising a universal joint interposed between the electric motor and rotatable motorized transfer roller to allow an oscillation of the axis of rotation (x) of rotatable motorized transfer roller relative to the horizontal plane.

5. The printing machine according to claim 1, wherein rotatable motorized transfer roller comprises an outer layer loaded with particles of a thermally conductive material and an inner layer of a synthetic thermally insulating material whose hardness and/or stiffness is less than that/those of said outer layer.

6. A printing machine—for printing images on articles, comprising:

a supporting structure, stationary in operation, a thermal transfer assembly movable in a predetermined horizontal direction and comprising a rotatable motorized transfer roller and heating means associated to the rotatable motorized transfer roller wherein rotatable motorized transfer roller has at least one outer layer of synthetic material with a peripheral surface facing a path of the articles and wherein rotatable motorized transfer roller and the associated heating means are movable vertically in said thermal transfer assembly towards and away from said path of the articles, and supply means arranged to advance, along a predetermined path extending in part between the active surface of rotatable motorized transfer roller and the path of the articles, a flexible printing ribbon which on a side facing the articles carries at predetermined intervals images formed of a thermally transferable ink, wherein the thermal transfer assembly further comprises first and second deviation rollers, whose axes of rotation are horizontal and substantially parallel with one another and with a axis of rotation (x) of rotatable motorized transfer roller and are also orthogonal to said predetermined horizontal direction, said first and second deviation rollers being placed one upstream and the other one downstream of rotatable motorized transfer roller on the path of said printing ribbon and being vertically movable in the thermal transfer assembly towards and away from said path of the articles, characterized in that said printing machine further comprises first and second motor means associated with said first and second deviation rollers, respectively, said first and second motor means being controllable independently of one another such that each of said first and second deviation rollers is selectively movable vertically independently of the other one, further comprising an electric motor coupled with rotatable motorized transfer roller via a unidirectional joint to cause the rotation of rotatable motorized transfer roller in a predetermined direction, whereby while the thermal transfer assembly is moved relative to the supporting structure along said predetermined horizontal direction corresponding to a direction of rotation of rotatable motorized transfer roller, the unidirectional joint allows rotatable motorized transfer roller to rotate to a highest speed among a speed imparted to rotatable motorized transfer roller by the electric motor and a speed imparted to rotatable motorized transfer roller as a result of the translational movement of the thermal transfer assembly.

7. The printing machine according to claim 6, further comprising a universal joint interposed between the electric motor and rotatable motorized transfer roller to allow an oscillation of the axis of rotation (x) of rotatable motorized transfer roller relative to the horizontal plane.

* * * * *